US006595127B2

(12) United States Patent
Ono

(10) Patent No.: US 6,595,127 B2
(45) Date of Patent: Jul. 22, 2003

(54) STENCIL PRINTING MACHINE WITH A WRINKLE PREVENTING MECHANISM FOR A STENCIL SHEET

(75) Inventor: Kinya Ono, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/880,956

(22) Filed: Jun. 15, 2001

(65) Prior Publication Data

US 2001/0052297 A1 Dec. 20, 2001

(30) Foreign Application Priority Data

Jun. 15, 2000 (JP) ..... 2000-180153

(51) Int. Cl.[7] ..... B41L 13/04
(52) U.S. Cl. ..... 101/116; 101/128.1; 101/477
(58) Field of Search ..... 101/116, 128.1, 101/128.4, 477

(56) References Cited

U.S. PATENT DOCUMENTS 5,048,416 A * 9/1991 Iijima ..... 101/115
5,438,347 A * 8/1995 Shishido et al. ..... 101/116
5,513,564 A * 5/1996 Sato ..... 101/116
5,575,204 A * 11/1996 Kawai et al. ..... 101/116
5,640,904 A * 6/1997 Sato et al. ..... 101/128.4
5,713,279 A * 2/1998 Iida et al. ..... 101/116
5,893,324 A * 4/1999 Kimura ..... 101/128.4
6,032,578 A * 3/2000 Nakamura ..... 101/116
6,230,617 B1 * 5/2001 Mori ..... 101/128.4

* cited by examiner

*Primary Examiner*—Stephen R. Funk
(74) *Attorney, Agent, or Firm*—Sughrue Mion, PLLC

(57) ABSTRACT

When a stencil sheet (M) is wound around an outer peripheral surface of a rotary cylindrical drum (24) in accordance with a rotation thereof, a leading end of the stencil sheet (M) is retained by a clamp plate (51) provided on the rotary cylindrical drum (24), and the stencil sheet (M) is conveyed while being guided by upper and lower guide plates (45, 46) and nipped between the lower guide plate (46) and a supporting member (48) attached to an underside of a swinging member (47). At this stage, predetermined tension is applied to the stencil sheet (M) by an urging force of the swinging member (47) to thereby prevent occurrence of wrinkles on the stencil sheet (M).

9 Claims, 5 Drawing Sheets

STENCIL PRINTING MACHINE WITH A WRINKLE PREVENTING MECHANISM FOR A STENCIL SHEET

BACKGROUND OF THE INVENTION

1. Field of the Invention

The present invention relates to a stencil printing machine in which a stencil sheet subjected to a stencil making process is attached to and wound around a rotary cylindrical drum.

The present application is based on Japanese Patent Application No. 2000-180153, which is incorporated herein by reference.

2. Description of the Related Art

Generally, a stencil printing machine has a rotary cylindrical drum in which an ink-permeable circumferential wall with a porous structure is arranged in a hollow cylindrical shape, and which is rotatable about its own axis. A stencil sheet subjected to a stencil making process is attached to and wound around the circumferential wall of the rotary cylindrical drum. An ink supplying device for supplying ink to an outer peripheral surface of the circumferential wall to allow the ink to permeate therethrough is disposed in the rotary cylindrical drum. Disposed on the outer side of the rotary cylindrical drum is a pressing device for pressing a printing sheet against the outer peripheral surface (the attached stencil sheet) of the circumferential wall. The printing sheet is fed into a nip between the rotary cylindrical drum and the pressing device in synchronism with the rotation of the rotary cylindrical drum, and the printing sheet is pressed against the stencil sheet attached to the rotary cylindrical drum so allow the ink to pass through perforated portions of the stencil sheet and to be transferred to the printing sheet, thereby effecting printing.

In this type of stencil printing machine, the stencil sheet is supported by being wound in roll form. The stencil sheet drawn out from the roll of stencil sheet has the shape of a continuous belt. This drawn-out stencil sheet is subjected to a stencil making process (i.e., thermographic perforation) by a thermal head. At the time of stencil making, the stencil sheet is conveyed while being guided into a nip between upper and lower guide plates and while coming into contact with the thermal head by the rotation of a platen roller opposing the thermal head. Further, a leading end of the stencil sheet subjected to a stencil making process is conveyed to a retaining member provided on the outer peripheral surface of the rotary cylindrical drum by pairs of load rollers. The retaining member clamps and fixes the leading end of the stencil sheet which has been conveyed. After the leading end of the stencil sheet is fixed by the retaining member, the stencil sheet is attached to and wound around the outer peripheral surface of the rotary cylindrical drum as the rotary cylindrical drum rotates. In addition, when the stencil sheet is attached to the rotary cylindrical drum, tension is imparted to the stencil sheet, whose leading end is fixed by the retaining member, by the nip of the pairs of load rollers. Then, the stencil sheet is cut into a stencil portion by a cutter unit while being attached to the rotary cylindrical drum.

However, with the above-described stencil printing machine, when the stencil sheet is attached to the rotary cylindrical drum, tension is imparted to the stencil sheet by the nip of the pairs of load rollers, but the stencil sheet assumes a state in which the tension is not imparted to it after a trailing end of the stencil sheet cut by the cutter unit has passed through the pairs of load rollers. Further, the trailing end of the stencil sheet tends to be oriented toward the outer peripheral surface of the rotary cylindrical drum owing to the tension imparted up until then. As a result, when the stencil sheet is attached to the rotary cylindrical drum, the stencil sheet is attached in such a manner that the trailing end of the stencil sheet is lifted from the outer peripheral surface of the rotary cylindrical drum. Hence, there has been a problem in that wrinkles are formed in this portion as it is pressed by the pressing device during printing, appearing as an image on the printing sheet.

It should be noted that the load rollers for imparting tension to the stencil sheet, including their driving mechanism, cannot be installed close to the rotary cylindrical drum in view of the need to avoid interference with the retaining member when the rotary cylindrical drum is rotated and interference with the retaining member which is operated when the retaining member retains the leading end of the stencil sheet.

SUMMARY OF THE INVENTION

Accordingly, it is an object of the present invention to provide a stencil printing machine which makes it possible to install the mechanism for imparting tension to the stencil sheet close to the rotary cylindrical drum and to prevent the occurrence of wrinkles in the stencil sheet attached to the rotary cylindrical drum, thereby overcoming the above-described drawbacks of the related art.

To achieve the above object, according to a first aspect of the present invention, there is provided a stencil printing machine which comprises: a rotary cylindrical drum rotatable about its own axis, the rotary cylindrical drum having a retaining member which retains, at an outer peripheral surface of the rotary cylindrical drum, a leading end of a stencil sheet which has been subjected to a stencil making process, wherein the stencil sheet is wound around the outer peripheral surface of the rotary cylindrical drum in accordance with a rotation thereof; a pair of upper and lower guide plates which guide conveyance of the stencil sheet to the rotary cylindrical drum; a swinging member having a swinging end portion which is vertically swingable while the swinging member is downwardly urged so that the swinging end portion is oriented toward the rotary cylindrical drum and located adjacent to an end portion of the upper guide plate oriented toward the rotary cylindrical drum; and a supporting member attached to an underside of the swinging member, the supporting member supporting the stencil sheet being conveyed, while nipping the stencil sheet in cooperation with the lower guide plate.

With the stencil printing machine in accordance with the first aspect of the present invention, the stencil sheet whose leading end is retained by the retaining member provided on the rotary cylindrical drum is attached to and wound around the rotary cylindrical drum as the rotary cylindrical drum rotates. At this juncture, the stencil sheet is conveyed while being guided by the upper and lower guide plates, and is nipped by the supporting member and the lower guide plate, and predetermined tension is applied to the stencil sheet by an urging force of the swinging member. Since the position for nipping the stencil sheet by the supporting member and the lower guide plate is at distal end portions of the upper and lower guide plates facing the rotary cylindrical drum, the tension is applied to the stencil sheet until immediately before the delivery of the stencil sheet from the upper and lower guide plates to the rotary cylindrical drum. As a result, it is possible to impart tension to the stencil sheet being attached to and wound around the rotary cylindrical drum in a range from the leading end to the trailing end of the stencil sheet, thereby making it possible to prevent the occurrence of the wrinkles when the stencil sheet is attached to the rotary cylindrical drum.

According to a second aspect of the present invention, in the stencil printing machine of the first aspect, it is preferable that when the retaining member is in an open state in order to retain the leading end of the stencil sheet, the retaining member abuts against the swinging end portion of the swinging member so that the swinging member swings, and in accordance with a swinging motion of the swinging member, the supporting member is moved away from the lower guide plate.

With the stencil printing machine in accordance with the second aspect of the present invention, when the retaining member is in an open state in order to retain the leading end of the stencil sheet, the swinging member is arranged to swing as the swinging end portion abuts against the retaining member, and the supporting member is moved away from the lower guide plate in conjunction with the swinging motion. Consequently, when the leading end of the stencil sheet is retained by the retaining portion, the stencil sheet can be guided without hampering the conveyance of the stencil sheet between the upper and lower guide plates.

According to a third aspect of the present invention, in the stencil printing machine of the first or second aspect, it is preferable that the supporting member includes a foamed elastic member, and the swinging member includes an elastic film.

With the stencil printing machine in accordance with the third aspect of the present invention, a simple arrangement is provided in which the supporting member is formed of, for example, a foamed elastic material, and the swinging member is formed of, for example, an elastic film. Therefore, the arrangement for obtaining the above-described effect can be applied to the upper and lower guide plates of an existing stencil printing machine without modifying a large number of component parts.

According to a fourth aspect of the present invention, in the stencil printing machine of the first or second aspect, the upper guide plate may have an insertion hole through which the supporting member is insertable, and in this case, the supporting member may be brought into contact with the stencil sheet through the insertion hole when the supporting member supports the stencil sheet being conveyed.

BRIEF DESCRIPTION OF THE DRAWINGS

The above and other objects and advantages of the present invention will become more apparent by describing in detail a preferred embodiment thereof with reference to the accompanying drawings, wherein.

DETAILED DESCRIPTION OF THE PREFERRED EMBODIMENT

Referring now to the accompanying drawings, a description will be given of an embodiment of a stencil printing machine in accordance with the present invention.

Figure 1:
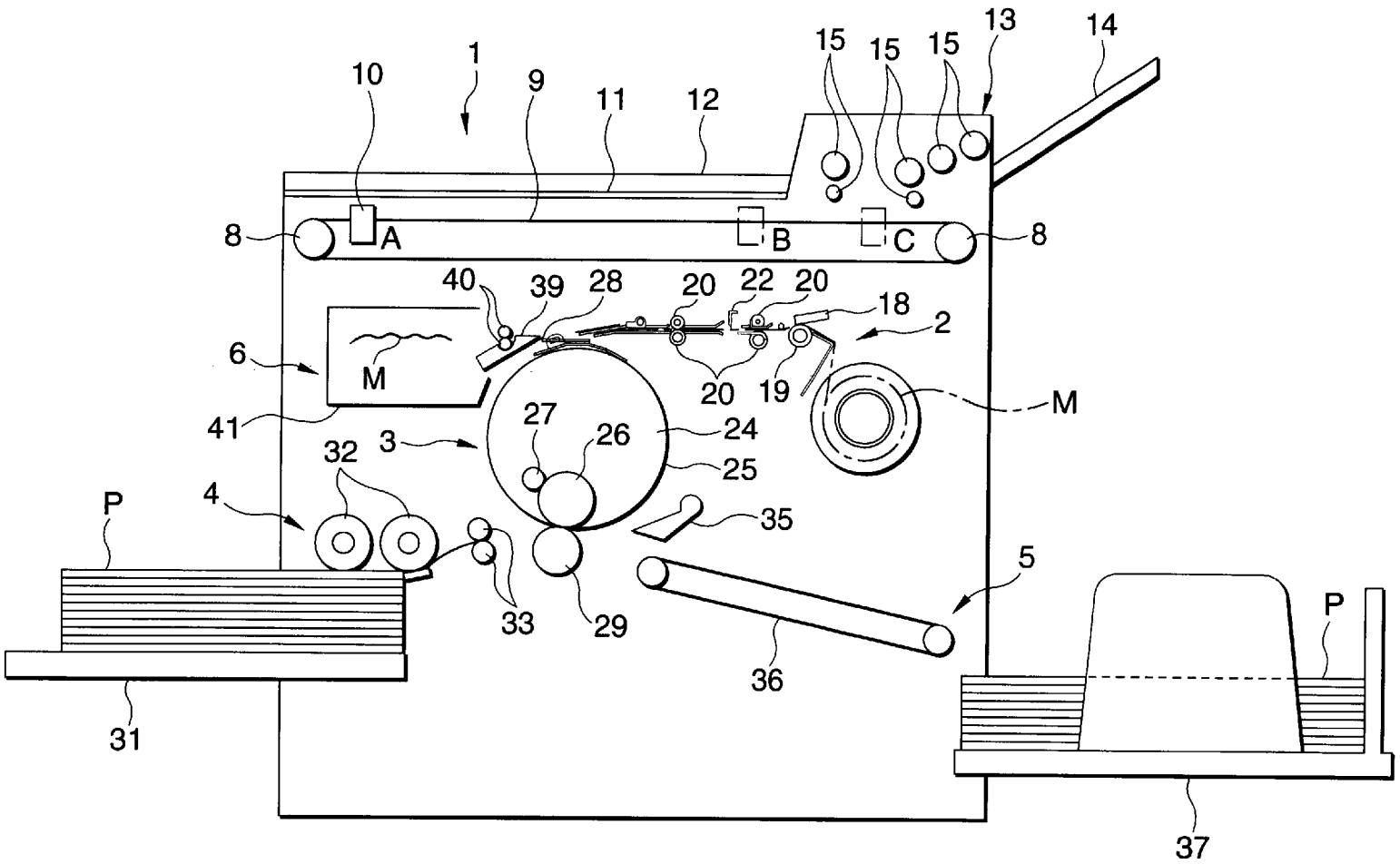
FIG. 1 is a side elevational view illustrating an embodiment of a stencil printing machine in accordance with the present invention.

FIG. 1 is a side elevational view illustrating an embodiment of the stencil printing machine in accordance with the present invention.

As shown in FIG. 1, the stencil printing machine comprises an original reading section 1, a stencil making section 2, a printing section 3, a sheet supplying section 4, a sheet discharging section 5, and a stencil discharging section 6.

The original reading section 1 is disposed in an upper portion of the stencil printing machine, and is so arranged as to be capable of reading an original bound in book form (hereafter referred to as a book original) and a single original in sheet form (hereafter referred to as a sheet original).

The arrangement for reading the book original and each sheet original comprises a line image sensor 10 which is moved in left-and-right directions in FIG. 1 by a moving mechanism in which an endless belt 9 is wound around and trained between a pair of rollers 8; an original-placed glass table 11 on which each original is placed; and a press cover 12 which is attached to the original-placed glass table 11 so as to be able to open and close.

When reading each original, the book original or the sheet original with its surface to be read facing down is placed on the original-placed glass table 11, and is pressed by the press cover 12 from above. Then, the line image sensor 10 is moved. The line image sensor 10 is made to scan and move at a predetermined speed between a home position A to a scan end position B shown in FIG. 1. As a result, an image on the original on the original-placed glass table 11 is read.

In addition, this stencil printing machine has an automatic original feeder 13 to read a plurality of sheet originals consecutively. The automatic original feeder 13 has an original setting tray 14 for stacking the plurality of sheet originals thereon. The sheet originals on the original setting tray 14 are fed one at a time into the automatic original feeder 13 by conveying rollers 15. In addition, the line image sensor 10 is moved to a position C (shown in FIG. 1) immediately below the automatic original feeder 13 by the aforementioned moving mechanism, and is fixedly disposed there. Consequently, the image on the sheet original which has been scanned is read. Upon completion of reading, the sheet original is fed out to the press cover 12 side outside the automatic original feeder 13.

The stencil making section 2 mainly comprises a stencil roll 17 in which a thermosensitive stencil sheet M made of a continuous sheet is stored in roll form; a thermal head 18 having a plurality of dot-like heating elements arranged in a horizontal row; a platen roller 19 arranged in face-to-face relation to the thermal head 18; pairs of load rollers 20; and a stencil cutter 22.

In the stencil making section 2, the stencil sheet M drawn out from the stencil roll 17 is fed into a nip between the thermal head 18 and the platen roller 19 by the rotation of the platen roller 19. In addition, image information concerning the image on the original which has been read by the line image sensor 10 is inputted to the thermal head 18. In the thermal head 18, the dot-like heating elements are individually operated selectively to generate heat in correspondence with this image information, thereby effecting a thermographic perforation stencil-making process in dot-matrix form on the stencil sheet M. The load rollers 20 feed the stencil sheet M subjected to a stencil making process to the downstream printing section 3. The stencil sheet M subjected to a stencil making process is cut into one stencil portion by the stencil cutter 22.

The printing section 3 has a rotary cylindrical drum 24. The rotary cylindrical drum 24 has an ink-permeable circumferential wall 25 with a porous structure formed in a hollow cylindrical shape, and is rotatable about its own axis in a counterclockwise direction shown in FIG. 1. The rotary cylindrical drum is rotatively driven by a driving mechanism (not shown). An ink supplying unit for supplying ink to an inner peripheral surface of the circumferential wall 25 is provided inside the circumferential wall 25. The ink supplying unit mainly includes a squeegee roller 26 and a doctor rod 27. A clamp portion 28 for clamping (retaining) a leading end of the stencil sheet M fed from the stencil making section 2 is provided on the outer peripheral surface of the rotary cylindrical drum 24. The stencil sheet M clamped by the clamp portion 28 is wound around the outer peripheral surface of the circumferential wall 25 as the rotary cylindrical drum 24 rotates.

In addition, the printing section 3 has a press roller 29 parallel to the axis of the rotary cylindrical drum 24. The press roller 29 is movable substantially vertically between a retreated position where the press roller 29 is moved away from the outer peripheral surface of the rotary cylindrical drum 24 by a drive unit (not shown) and a pressure-contacting position where it is pressed against the outer peripheral surface of the rotary cylindrical drum 24. The press roller 29, when located at the pressure-contacting position, presses a printing sheet P against the stencil sheet M located on the outer peripheral surface of the rotary cylindrical drum 24. Consequently, the ink supplied to the inner peripheral surface of the circumferential wall 25 by the ink supplying unit passes through perforated portions of the stencil sheet M through ink permeable portions of the circumferential wall 25, thereby forming a desired image on the printing sheet P.

The sheet supplying section 4 has a sheet supplying tray 31 on which the printing sheets P before printing are stacked. The printing sheets P stacked on the sheet supplying tray 31 are paid out one at a time by sheet supplying rollers 32. Further, the paid-out printing sheet P is fed into the nip between the rotary cylindrical drum 24 and the press roller 29 at a predetermined timing by timing rollers 33 synchronized with the rotation of the rotary cylindrical drum 24.

The sheet discharging section 5 has a releasing pawl 35 for releasing the printing sheet P printed in the printing section 3 from the rotary cylindrical drum 24. The printing sheet P released from the rotary cylindrical drum 24 is conveyed to a sheet discharging tray 37 by a belt-conveyor type sheet conveying unit 36. The printing sheets P which have been printed are consecutively stacked on the sheet discharging tray 37 with the printed image sides facing upward.

The stencil discharging section 6 has a discharged-stencil separating pawl 39 for separating from the rotary cylindrical drum 24 the used stencil sheet M wound around the outer peripheral surface of the rotary cylindrical drum 24. When the stencil sheet M is separated from the rotary cylindrical drum 24, the clamping of the stencil sheet M by the clamping portion 28 is canceled, and an end portion of the stencil sheet M released in conjunction with the rotation of the rotary cylindrical drum 24 is caught by the discharged-stencil separating pawl 39. The stencil sheet M caught by the discharged-stencil separating pawl 39 is peeled off the outer peripheral surface of the rotary cylindrical drum 24 by further rotation of the rotary cylindrical drum 24. The stencil sheet M separated by the discharged-stencil separating pawl 39 is conveyed by stencil discharging rollers 40, and is accommodated in a discharged-stencil box 41.

Hereafter, a description will be given of the configurations of the stencil making section 2 and the printing section 3 (rotary cylindrical drum 24) concerning the conveying and attaching operations of the stencil sheet M in the stencil printing machine constructed as described above.

Figure 2:
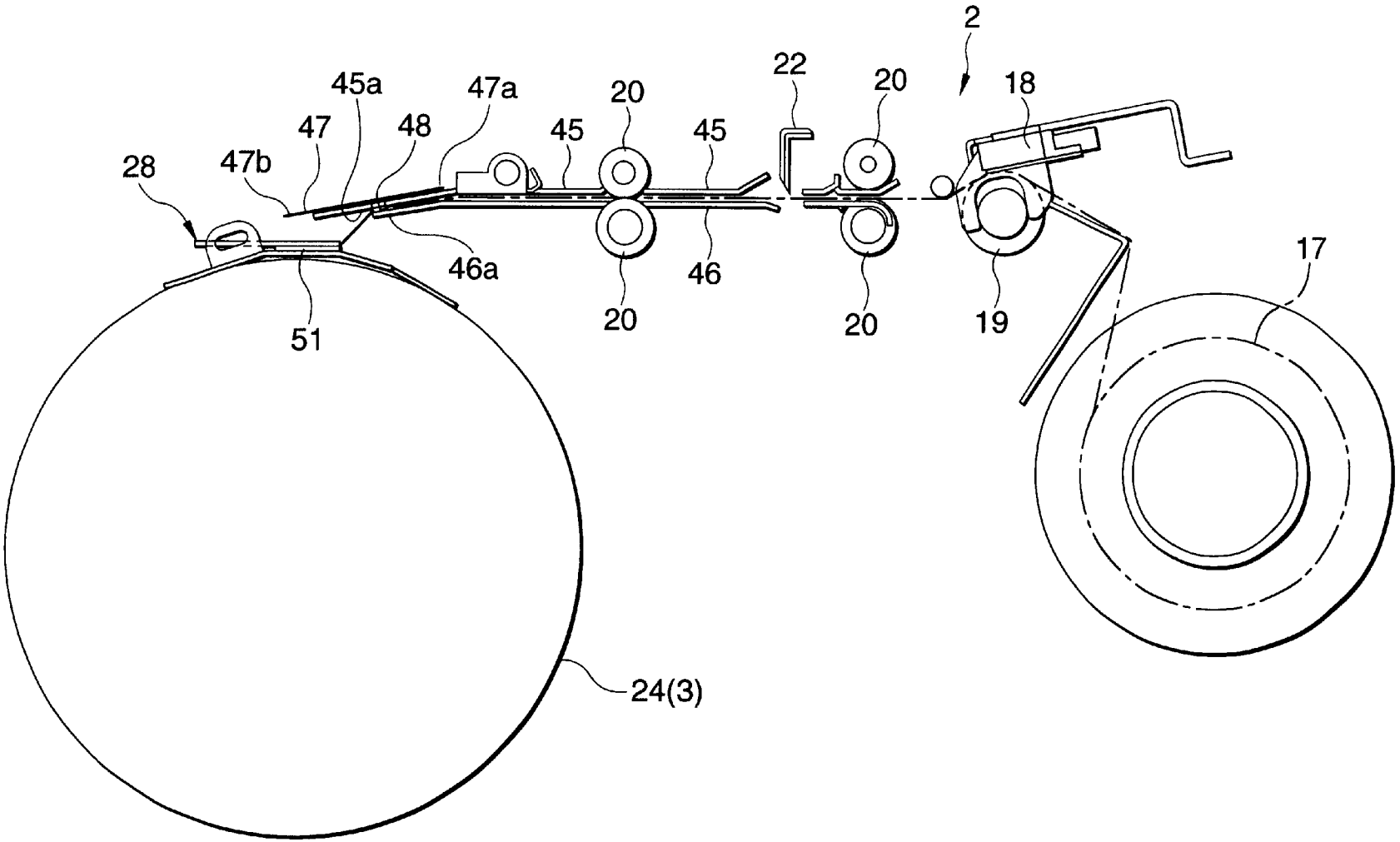
FIG. 2 is a side elevational view illustrating a configuration concerning the conveying and attaching operations of a stencil sheet.
Figure 3:
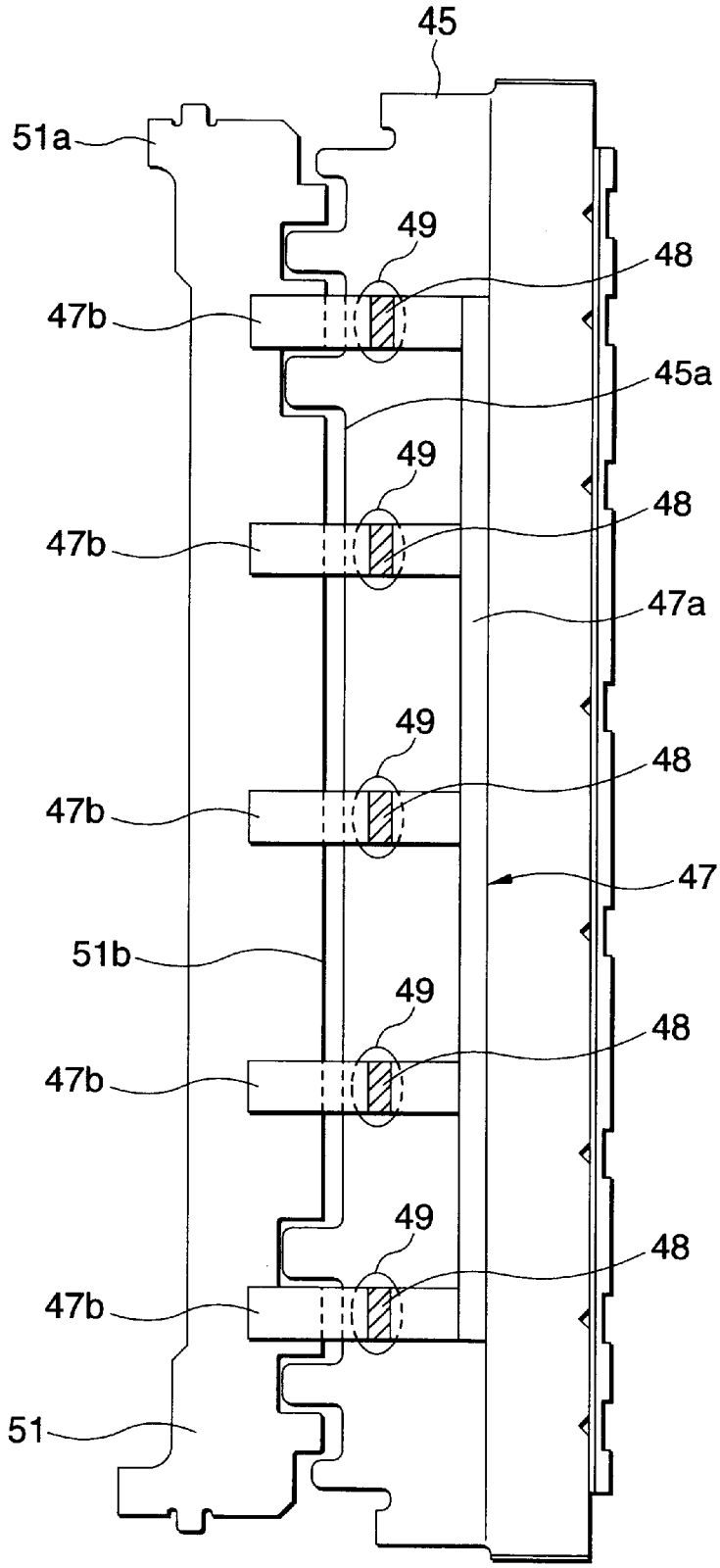
FIG. 3 is a plan view similarly illustrating the configuration concerning the conveying and attaching operations of the stencil sheet.

FIG. 2 is a side elevational view illustrating the configuration concerning the conveying and attaching operations of the stencil sheet, and FIG. 3 is a plan view similarly illustrating the configuration concerning the conveying and attaching operations of the stencil sheet.

First, as shown in FIG. 2, a pair of upper and lower guide plates 45 and 46 are provided in the stencil making section 2. The upper and lower guide plates 45 and 46 are provided in such a manner as to extend between, on the one hand, the thermal head 18 and the platen roller 19 and, on the other hand, the clamp portion 28 of the rotary cylindrical drum 24. The upper and lower guide plates 45 and 46 guide the conveyance of the stencil sheet M toward the clamp portion 28 when the stencil sheet M drawn out from the stencil roll 17 is conveyed toward the rotary cylindrical drum 24 side through the thermal head 18, the platen roller 19, and the stencil cutter 22.

As shown in FIGS. 2 and 3, a distal end portion 45*a* of the upper guide plate 45 extends longer toward the rotary cylindrical drum 24 side (clamp portion 28 side) than a distal end portion 46*a* of the lower guide plate 46. A swinging member 47 is provided on an upper surface of the upper guide plate 45 in such a manner as to extend beyond the distal end portion 45*a* of the upper guide plate 45. The swinging member 47 is formed of an elastic film having desired elasticity. As the elastic film, a film made of polyethylene terephthalate is preferable, or it may be a film of another plastic. The swinging member 47 has its proximal end 47*a* bonded and fixed to an upper surface of a proximal end of the upper guide plate 45 by way of a pressure sensitive adhesive double coated tape or the like, and is provided such that its swinging end portions 47*b* (five swinging end portions 47*b* in this embodiment) oriented toward the rotary cylindrical drum 24 (clamp portion 28) are vertically swingable by deflection. Further, as for the swinging member 47, the swinging end portions 47*b* are formed in such a manner as to project from the distal end of the upper guide plate 45 in the conveying direction of the stencil sheet M. In addition, as shown in FIG. 3, as for the swinging member 47 in this embodiment, its proximal end 47*a* fixed to the upper guide plate 45 is formed in an elongated shape along the widthwise direction of the upper guide plate 45 (in the widthwise direction of the stencil sheet M), and the swinging end portions 47*b* extend from this longitudinal proximal end 47*a* in the conveying direction of the stencil sheet M.

In addition, as shown in FIGS. 2 and 3, the swinging member 47 is provided with supporting members 48. The supporting members 48 are formed of a foamed elastic material such as soft urethane foam. The supporting members 48 are bonded and fixed to the underside of the swinging member 47 by a pressure sensitive adhesive double coated tape or the like, and abut against an upper surface of the distal end portion 46*a* of the lower guide plate 46 through insertion holes 49 formed in the upper guide plate 45.

Figure 4:
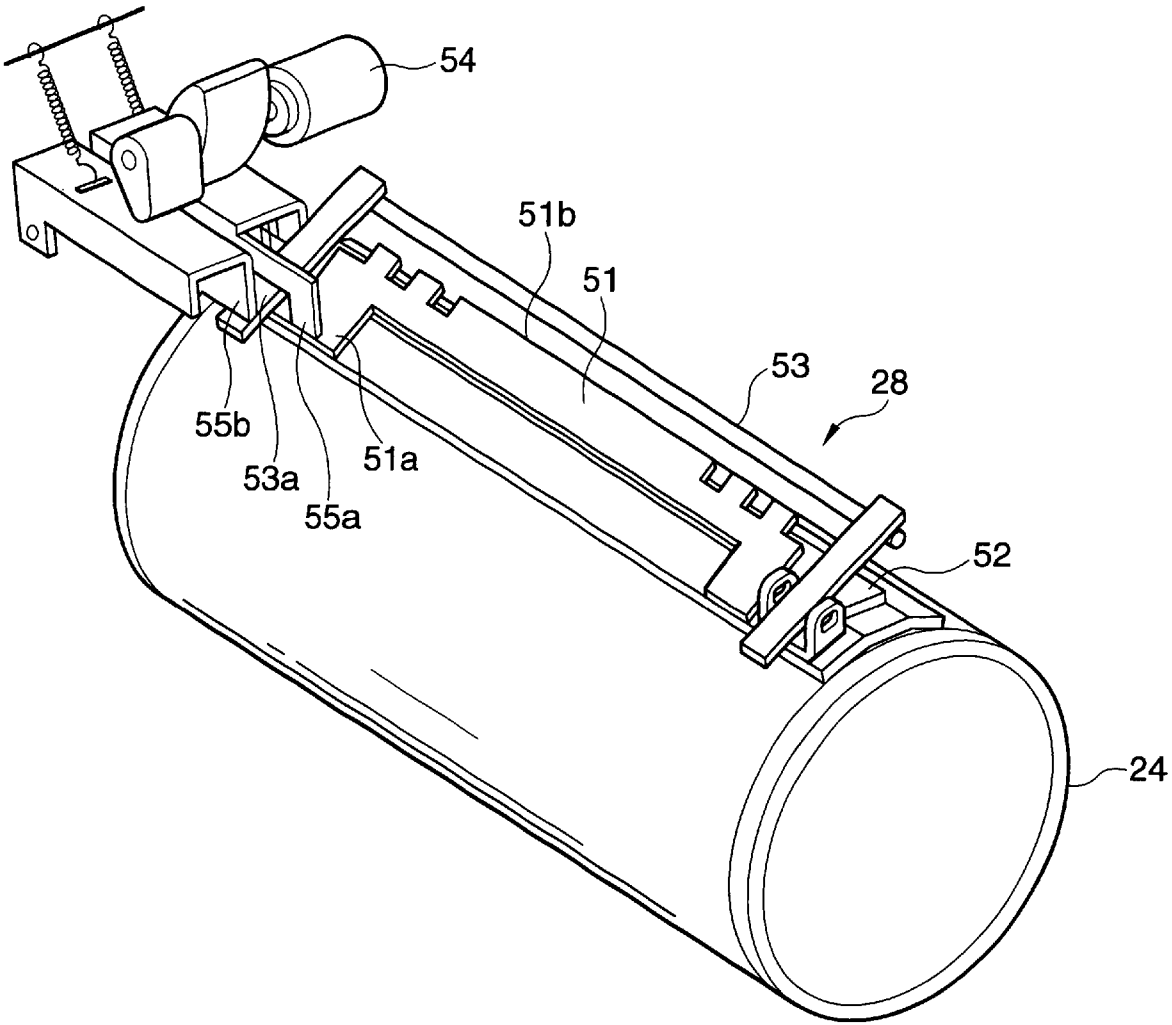
FIG. 4 is a perspective view illustrating a retaining member.

Next, the aforementioned clamp portion 28 is provided on the outer peripheral surface of the rotary cylindrical drum 24. As shown in FIG. 4, the clamp portion 28 has a clamp plate 51 which is provided on the outer peripheral surface of the rotary cylindrical drum 24 operably toward the upper and lower guide plates 45 and 46, and which serves as a retaining member formed of magnetic sheet metal. Further, a magnetic plate 52 for attracting the clamp plate 51 is provided on the outer peripheral surface side of the rotary cylindrical drum 24 and below the clamp plate 51. The arrangement provided is such that the leading end of the conveyed stencil sheet M subjected to a stencil making process is clamped by the magnetic plate 52 and the clamp plate 51 attracted thereto.

In this embodiment, the clamp plate 51 is arranged in the form of a lever so as to make leverage. The clamp plate is normally attached to the magnetic plate 52. Further, a springing-up member 53 which opens and closes in the same way as the clamp plate 51 is provided forwardly of the opening and closing end of the clamp plate 51. This springing-up member 53 is also arranged in the form of a lever so as to make leverage, and is normally attracted to the magnetic plate 52. Actuating elements 55*a* and 55*b* which are moved by being driven by a motor 54 respectively abut against points of action 51*a* and 53*a* of the clamp plate 51 and the springing-up member 53. As the actuating elements 55*a* and 55*b* press the respective points of action 51*a* and 53*a*, the clamp plate 51 and the springing-up member 53 are set in a predetermined open state shown in FIG. 4. It should be noted that the arrangement for opening the clamp plate 51 and the springing-up member 53 is not confined to the one based on the motor 54 and the actuating elements 55*a* and 55*b*, and it is possible to adopt, for instance, an arrangement using a cam mechanism accompanying the rotation of the rotary cylindrical drum 24, or an arrangement using the polarity of the magnetic plate 52.

The springing-up member 53 is set in an open state only during the discharging of the stencil sheet at a driving timing of the motor 54. Consequently, during the attachment of the stencil sheet, in a state in which the stencil sheet M being guided by the upper and lower guide plates 45 and 46 on the stencil making section 2 is located on the upper side of the springing-up member 53, and has been conveyed to a position above the magnetic plate 52, the clamp plate 51 is set in an attracting position. In this state, the leading end of the stencil sheet M is clamped by the clamp plate 51 and the magnetic plate 52. Then, during the discharging of the stencil sheet, as shown in FIG. 4, both the clamp plate 51 and the springing-up member 53 are set in an open state, and the leading end of the stencil sheet M clamped by the clamp plate 51 and the magnetic plate 52 is sprung up to the upper surface side of the clamp plate 51 by the springing-up member 53 so as to be released.

It should be noted that, as shown in FIG. 3, portions of a distal end portion 51*b* of the clamp plate 51 are formed in a comb shape. Further, portions of the distal end portion 45*a* of the upper guide plate 45 are formed in a comb shape. The comb-shaped portions of the clamp plate 51 and the upper guide plate 45 are provided such that when the clamp plate 51 is opened, the comb-shaped portions are interdigitated without touching each other, and the distal end portion 45*a* of the upper guide plate 45 is located on the lower side than the distal end portion 51*b* of the clamp plate 51 which is in a predetermined open state. As a result, the stencil sheet M which has been conveyed between the upper and lower guide plates 45 and 46 is appropriately guided into a nip between the clamp plate 51 and the magnetic plate 52 (see FIG. 5A). In addition, at the time of opening during stencil sheet discharging, the springing-up member 53 comes into contact with the upper guide plate 45. In this embodiment, as shown in FIGS. 5A, 5B, and 5C, since the distal end portion 45*a* of the upper guide plate 45 is swung about a shaft 56, the opening of the springing-up member 53 is not hampered.

Hereafter, a description will be given of the operation of the swinging member 47 and the supporting members 48 accompanying the operation of the clamp plate 51. FIGS. 5A, 5B, and 5C are side elevational views illustrating the operation of the swinging member and the supporting members.

First, when the clamp plate 51 is opened, the rotation of the rotary cylindrical drum 24 is stopped so that the clamp plate 51 assumes a predetermined position shown in FIG. 2, so as to allow the clamp plate 51 to retain the leading end of the stencil sheet M. This stop position of the rotary cylindrical drum 24 is detected by a detecting device (not shown) for detecting the position of rotation of the rotary cylindrical drum 24, and the driving mechanism of the rotary cylindrical drum 24 is controlled by a detection signal of the detecting device.

Figure 5A:
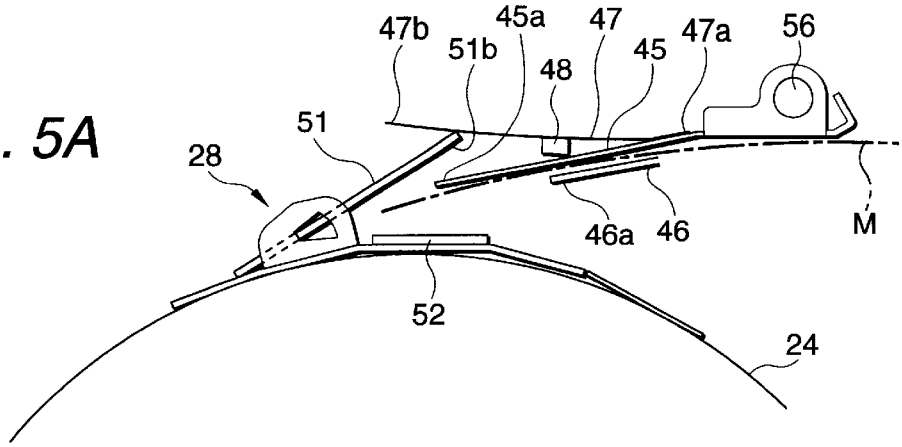
FIGS. 5A to 5C are side elevational views illustrating the operation of a swinging member and supporting members.
Figure 5B:
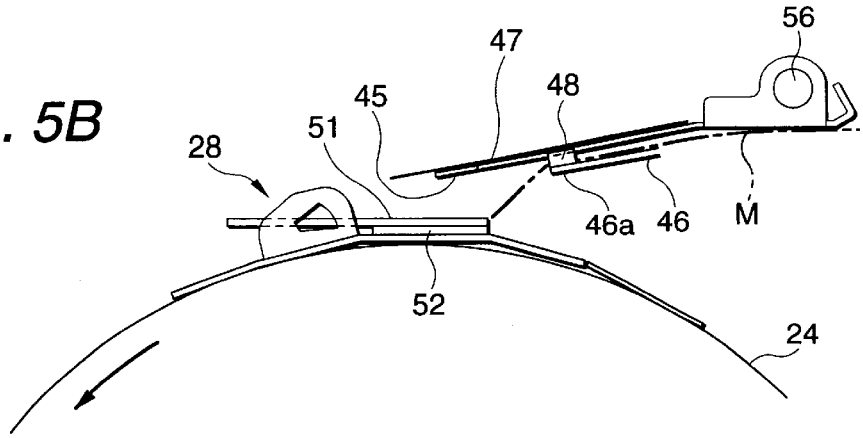
Figure 5C:
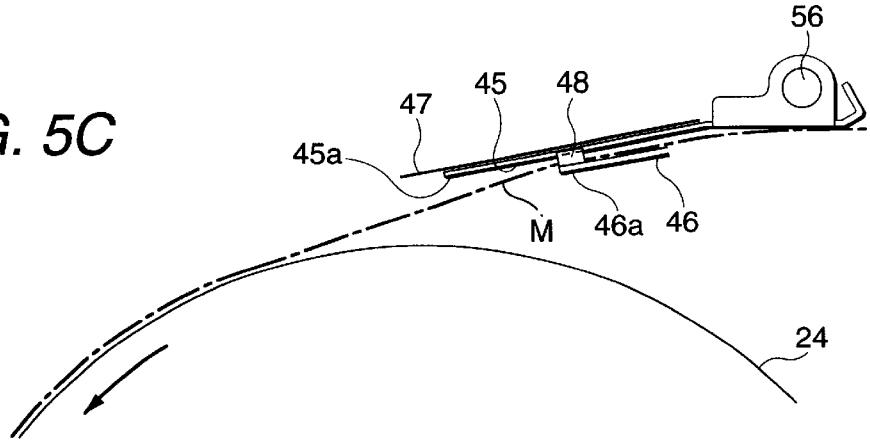

As shown in FIG. 5A, when the clamp plate 51 is opened at the predetermined position, the distal end portion 51*b* of the clamp plate 51 abuts against the swinging end portions 47*b* of the swinging member 47 fixed to the upper guide plate 45. Then, the swinging member 47 is pushed up by the clamp plate 51, and is swung upward by its own deflection. In conjunction with this swinging motion, the supporting members 48 are lifted upward, and are hence spaced apart from the lower guide plate 46. Consequently, the upper and lower guide plates 45 and 46 are opened to allow the passage of the stencil sheet M therethrough. Then, the stencil sheet M, which has been guided between the distal end portions 45*a* and 46*a* of the upper and lower guide plates 45 and 46, is led into the gap between the clamp plate 51 and the magnetic plate 52.

As shown in FIG. 5B, when the clamp plate 51 is attracted to the magnetic plate 52, the leading end of the stencil sheet M, which has been led into the gap between the clamp plate 51 and the magnetic plate 52 as described above, is clamped by the clamp plate 51 and the magnetic plate 52. In this state, the abutment of the clamp plate 51 against the swinging member 47 is canceled, so that the swinging member 47 is swung downward by its own resiliency. In conjunction with this swinging motion, the supporting members 48 is lowered, and abuts against the lower guide plate 46. Consequently, the stencil sheet M clamped earlier the clamp plate 51 is nipped by the supporting members 48 and the lower guide plate 46.

Subsequently, as the rotary cylindrical drum 24 rotates in the direction of the arrow shown in FIG. 5B, the stencil sheet M is attached to and wound around the outer peripheral surface of the rotary cylindrical drum 24. At this time, the stencil sheet M is drawn out from between the upper and lower guide plates 45 and 46 while its leading end is being pulled by being retained by the clamp portion 28, and tension is imparted to the stencil sheet M as the stencil sheet M is nipped by the supporting members 48 and the lower guide plate 46. It should be noted that the supporting members 48 are formed of a foamed elastic material, and the swinging member 47 to which these supporting members 48 are attached is formed of an elastic film. Consequently, the tension imparted to the stencil sheet M by the nip between the supporting members 48 and the lower guide plate 46 becomes tension which does not hamper the drawing out (conveyance) of the stencil sheet M and does not slacken the stencil sheet M.

In addition, the position where the stencil sheet M is nipped by the supporting members 48 and the lower guide plate 46 is the position which is closest to the rotary cylindrical drum 24 for drawing out the stencil sheet M from the nip between the upper and lower guide plates 45 and 46. Namely, in the conveyance of the stencil sheet M from the stencil making section 2 to the printing section 3 (rotary cylindrical drum 24), tension is imparted to the stencil sheet M at the mutually closest position for delivering the stencil sheet M.

Consequently, as shown in FIG. 5C, tension is applied to the stencil sheet M until immediately before the delivery of the stencil sheet M from the stencil making section 2 (upper and lower guide plates 45 and 46) to the printing section 3 (rotary cylindrical drum 24) when the rear end of the stencil sheet M leaves the nip between the supporting members 48 and the lower guide plate 46. Therefore, wrinkles are not formed in the stencil sheet M, from its leading end to its trailing end, attached to and wound around the rotary cylindrical drum 24.

In addition, since the swinging member 47 is formed of an elastic film, and the supporting members 48 are formed of a foamed elastic material, the arrangement for obtaining the above-described effect can be applied to the upper and lower guide plates 45 and 46 of an existing stencil printing machine without modifying a large number of component parts.

Although in the above-described embodiment the swinging member 47 is formed of an elastic film, the swinging member 47 is not limited to the elastic film insofar as the arrangement is capable of effecting swinging for causing the swinging member 47 to be pushed up by the clamp plate 51 when the clamp plate 51 is opened and of producing resiliency for allowing the tension to be imparted to the stencil sheet M being conveyed between the supporting members 48 and the lower guide plate 46. For example, as the swinging member 47 it is possible to adopt an arrangement in which a plate member is made swingable about a supporting shaft, and the supporting members 48 are resiliently urged appropriately against the lower guide plate 46 by a resilient member (a spring or the like). Still alternatively, an arrangement may be provided such that the aforementioned plate member urges the supporting members 48 against the lower guide plate 46 by its own weight without using the aforementioned resilient member (resiliency) for urging the supporting members 48 against the lower guide plate 46. At this juncture, in a case where a desired urging force cannot be obtained by the weight of the plate member alone, a desired urging force can be obtained by attaching a weight to the plate member.

In addition, although in the arrangement in accordance with the above-described embodiment each supporting member 48 is formed of a foamed elastic material and is formed in the shape of a rectangular parallelepiped as shown in FIGS. 3 and 5A to 5C, the supporting members 48 are not limited to the aforementioned material or construction insofar as the supporting members 48 do not hamper the conveyance of the stencil sheet M and does not cause damage to the stencil sheet M when the stencil sheet M being conveyed is nipped. For example, as the material of the supporting members 48 a nonwoven fabric may be adopted instead of the foamed elastic material, and the supporting members 48 may be formed as rollers in terms of the shape of the supporting members 48.

It is contemplated that numerous modifications may be made to the stencil printing machine of the present invention without departing from the spirit and scope of the invention as defined in the following claims.

What is claimed is:

1. A stencil printing machine, comprising:

a rotary cylindrical drum rotatable about its own axis, the rotary cylindrical drum having a retaining member which retains, at an outer peripheral surface of the rotary cylindrical drum, a leading end of a stencil sheet which has been subjected to a stencil making process, wherein the stencil sheet is wound around the outer peripheral surface of the rotary cylindrical drum in accordance with a rotation thereof;

a pair of upper and lower guide plates which guide conveyance of the stencil sheet to the rotary cylindrical drum;

a swinging member having a swinging end portion which is vertically swingable while the swinging member is downwardly urged so that the swinging end portion is oriented toward the rotary cylindrical drum and located adjacent to an end portion of the upper guide plate oriented toward the rotary cylindrical drum; and a supporting member attached to an underside of the swinging member, the supporting member supporting the stencil sheet being conveyed, while nipping the stencil sheet in cooperation with the lower guide plate.

2. The stencil printing machine of claim 1, wherein when the retaining member is in an open state in order to retain the leading end of the stencil sheet, the retaining member abuts against the swinging end portion of the swinging member so that the swinging member swings, and in accordance with a swinging motion of the swinging member, the supporting member is moved away from the lower guide plate.

3. The stencil printing machine of claim 2, wherein the supporting member includes a foamed elastic member, and the swinging member includes an elastic film.

4. The stencil printing machine of claim 2, wherein the upper guide plate has an insertion hole through which the supporting member is insertable, and wherein the supporting member is brought into contact with the stencil sheet through the insertion hole when the supporting member supports the stencil sheet being conveyed.

5. The stencil printing machine of claim 1, wherein the supporting member includes a foamed elastic member, and the swinging member includes an elastic film.

6. The stencil printing machine of claim 1, wherein the upper guide plate has an insertion hole through which the supporting member is insertable, and wherein the supporting member is brought into contact with the stencil sheet through the insertion hole when the supporting member supports the stencil sheet being conveyed.

7. The stencil printing machine of claim 1, wherein the swinging member is swingable by a deflection thereof.

8. The stencil printing machine of claim 1, wherein the swinging member is fixed to the upper guide plate at a proximal end thereof.

9. The stencil printing machine of claim 1, wherein a proximal end of the swinging member is formed in an elongated shape along the width wise direction of the upper guide plate.

* * * * *